US005803586A

United States Patent [19]

Velez et al.

[11] Patent Number: 5,803,586

[45] Date of Patent: Sep. 8, 1998

[54] ILLUMINATED TOOL CADDY

[76] Inventors: Salvador A. Velez, P.O. Box 354, Hollister, Calif. 95024; Filiberto Rodriguez, 1330 Ramona Ave.; Carlos A. Ruiz, 1081 Wood Ct., both of Hollister, Calif. 95023

[21] Appl. No.: 600,681

[22] Filed: Feb. 13, 1996

[51] Int. Cl.[6] ..... F21V 33/00

[52] U.S. Cl. ..... 362/154; 362/234; 362/240; 362/241; 362/247; 206/372

[58] Field of Search ..... 362/154–156, 362/184, 186, 234, 240, 241, 244, 245, 247, 249, 251, 252, 367; 206/372, 373, 561; 220/771

[56] References Cited

U.S. PATENT DOCUMENTS

| | | | |
|---|---|---|---|
| 1,405,422 | 2/1922 | Kennedy | 206/373 |
| 1,645,487 | 10/1927 | Harling | 362/184 |
| 2,276,370 | 3/1942 | Conrad | 362/156 |
| 2,517,914 | 8/1950 | Nowaczek | 362/155 |
| 3,404,267 | 10/1968 | Zucker | 362/184 |
| 3,618,749 | 11/1971 | Vaccaro | 206/372 |
| 4,791,402 | 12/1988 | Vaughn | 362/240 |
| 4,933,820 | 6/1990 | Engel | 362/367 |
| 5,071,004 | 12/1991 | Rivera | 206/372 |
| 5,219,446 | 6/1993 | Klepac | 362/154 |
| 5,246,285 | 9/1993 | Redburn et al. | 362/155 |
| 5,344,339 | 9/1994 | Cheslock | 439/501 |
| 5,539,626 | 7/1996 | Scholz | 362/251 |

*Primary Examiner*—Alan Cariaso
*Attorney, Agent, or Firm*—Michael J. Hughes; Mark E. Baze

[57] ABSTRACT

An illuminated tool caddy (10) is provided for the carrying of tools and parts, and for illumination of work detail related thereto. The primary components of the illuminated tool caddy (10) are a tool carrier (12) and a lamp (14). The lamp (14) is situated within the tool carrier (12) and is of a height such that a bulb housing (44) extends above the side walls (18) of the tool carrier (12). Within the bulb housing (44) are five individual lighting compartments (48), each of which contains a light bulb (54). Reflector facets (56) within each lighting compartment (48) assist in reflecting and directing the light from the light bulbs (54) to give the lamp (14) a hands-free, multidirectional lighting ability. The lamp (14) is capable of simultaneously casting light in any direction, including not only to any side and upwardly, but to the ground and into the interior of the tool carrier (12) as well. The lamp (14) is also removable from the tool carrier for hand-held applications where that is desired. In the preferred embodiment, the tool carrier (12) includes end walls (20) with arcuately fashioned lower portions (40) which provide that the illuminated tool caddy (10) may be dragged or pulled along the ground surface within crawl spaces when it otherwise may not be lifted and carried.

16 Claims, 3 Drawing Sheets

ILLUMINATED TOOL CADDY

TECHNICAL FIELD

The present invention relates generally to portable tool caddies, and more particularly to such tool caddies as have a light source associated with them.

BACKGROUND ART

When working with tools, use of a light source is often necessary to supplement any ambient light that may be present in the particular working environment in order that the work detail may be more clearly seen. Commonly employed are hand-held flashlights. Such flashlights are limiting in that one hand must hold the light, thereby leaving only one hand free for tool manipulation and application. A hand-held flashlight may be contrived to be held and aimed by the worker other than with a hand, but generally such is possible only with great awkwardness and frustration. Likewise, a flashlight may be positionable and directable by leaning it on or against a stationary structure or by wedging it between such structures. Again, however, this is generally quite awkward and the availability of appropriately positioned structures for suitable positioning of the flashlight may not be available. Where a tool box or tool caddy is employed, as of course is often the case when working with tools, some improvement in flexibility in the positioning of the flashlight may be obtained by supporting the flashlight on or within such a tool caddy. The flashlight may even be attached in makeshift fashion with adhesive tape or in some other manner to the tool caddy to provide a more stable light source. A light source other than a flashlight, such as a "drop-light," may also be employed when working with tools, but such lights suffer from similar limitations inherent in flashlights, namely a suitable structure must be present from which to hang or position such lights, and orientation of the light emitted may be problematic.

To overcome the foregoing limitations, at least in the instances in which it is useful to also have a tool toting capability, various types of tool caddies as incorporate a built-in light fixture have been proposed. In U.S. Pat. No. 5,219,446, issued to Klepac on 15 Jun., 1995, a number of such inventions are set forth as prior art. In the Klepac patent itself is shown a portable tool box having a fixedly attached, swivable light mounted at one end of the tool box. The ready availability of the light and the ability to swivel the light to direct the light beam in various directions makes the invention quite useful. However, the light fixture itself has essentially little more capability than a common flashlight, since it emits a directed beam only. Thus, to illuminate a particular work area, the light must be swiveled, or the tool box reoriented to accomplish this. The lighting system of Klepac also does not provide for illumination of the tool box itself. Thus, if some small tool or part requires retrieval from within the tool box, the light must be swiveled toward the tool box interior (it is actually not clear from the patent whether the light fixture even has this capability), or a secondary light, such as a flashlight, must be employed to view the contents of the tool box. Thus, there always exists the need (and annoyance) for adjustment of the orientation of the light source.

Shown in U.S. Pat. No. 5,344,339, issued to Cheslock on 6 Sep., 1994, is a portable caddy which also incorporates a directed beam light source at one end of the caddy. The light source of Cheslock, while not having the versatility of Klepac's swivably mounted light, is distinguishable in that it is detachable to permit employment by hand when necessary. The inventions of both Cheslock and Klepac do conveniently provide for built-in, multi-socket electrical receptacles for powering electric tools.

It will be appreciated from the foregoing, that while a tool caddy with a built-in light source is indeed an extremely useful device for a variety of applications, including working in crawl spaces beneath houses, working in attics, and performing automobile maintenance on and under automobiles, and also for recreational activities such as fishing when enjoyed during twilight hours, such inventions as are presently available do not provide for as complete a freedom from adjustment of the light source as would be desirable. Because of this limitation, a substantial need still exists for a tool caddy having an illumination capability that requires considerably less attention to achieve a sufficiently lighted work area.

DISCLOSURE OF THE INVENTION

Accordingly, it is an object of the present invention to provide a tool caddy with a built-in light source that does not require aiming or reorientation to illuminate any particular work area or detail.

It is another object of the invention to provide a tool caddy with a light source capable of simultaneously illuminating the contents of the tool caddy.

It is a further object to provide a tool caddy with enhanced features for working in crawl spaces beneath houses.

It is yet another object to provide a tool caddy having a uniquely designed, multi-faceted light.

It is yet a further object to provide a tool caddy having a detachable light source for hand-held operation of the light.

Briefly, the preferred embodiment of the present invention is an illuminated tool caddy for carrying of tools and parts, and for illumination of work detail related thereto. The primary components of the illuminated tool caddy are a tool carrier and a lamp, both of which are uniquely designed to provide heretofore unavailable capabilities to the worker. The tool carrier is compartmentalized and provided with such usual features as enhance traditional tool boxes. In addition, however, the tool carrier includes end walls with arcuately fashioned lower portions strategically located where the end walls join with the bottom of the tool carrier. The curved nature of the end walls, together with a pulling ring attached to the exterior surfaces of each of the end walls, provides that the illuminated tool caddy may be dragged or pulled along the ground surface within crawl spaces when it otherwise may not be lifted and carried.

The unique design of the lamp provides the illuminated tool caddy with a greatly enhanced lighting and working capability. The lamp is situated within the tool carrier and is of a height such that a bulb housing portion thereof extends above the side walls of the tool carrier. Within the bulb housing are five individual lighting compartments, each of which contain a light bulb. Reflector facets within each lighting compartment assist in reflecting and directing the light from the light bulbs to give the lamp not only a multifaceted appearance, but most importantly, a hands-free, multidirectional lighting ability. The lamp is capable of simultaneously casting light in any direction, including not only to any side and upwardly, but to the ground and into the interior of the tool carrier as well. The foregoing means that annoying reorientation or re-situation of a light source while a job is being performed is greatly reduced, or eliminated altogether. The lamp is also removable from the tool carrier for hand-held applications where that is desired.

An advantage of the present invention is that the illuminated tool caddy may be situated in one position while work may be performed in a number of different directions without having to reorient a light source towards each direction.

Another advantage of the invention is that the interior of the tool carrier is provided with illumination for easy retrieval of tools and parts therein without having to redirect a light source for such interior illumination.

A further advantage is that the lamp may be removed from the tool carrier for effective operation as a flashlight where that is desired.

Yet another advantage is that the lamp contains a plurality of light bulbs making it highly unlikely that a total lighting failure will occur while work is being performed due to bulb burnout.

Yet a further advantage is that the tool carrier slides easily along the ground for convenient transport and movement within crawl spaces or similarly restricted spaces.

These and other objects and advantages of the present invention will become clear to those skilled in the art in view of the description of the best presently known mode of carrying out the invention as described herein and as illustrated in the several figures of the drawings.

BEST MODE FOR CARRYING OUT THE INVENTION

Figure 1:
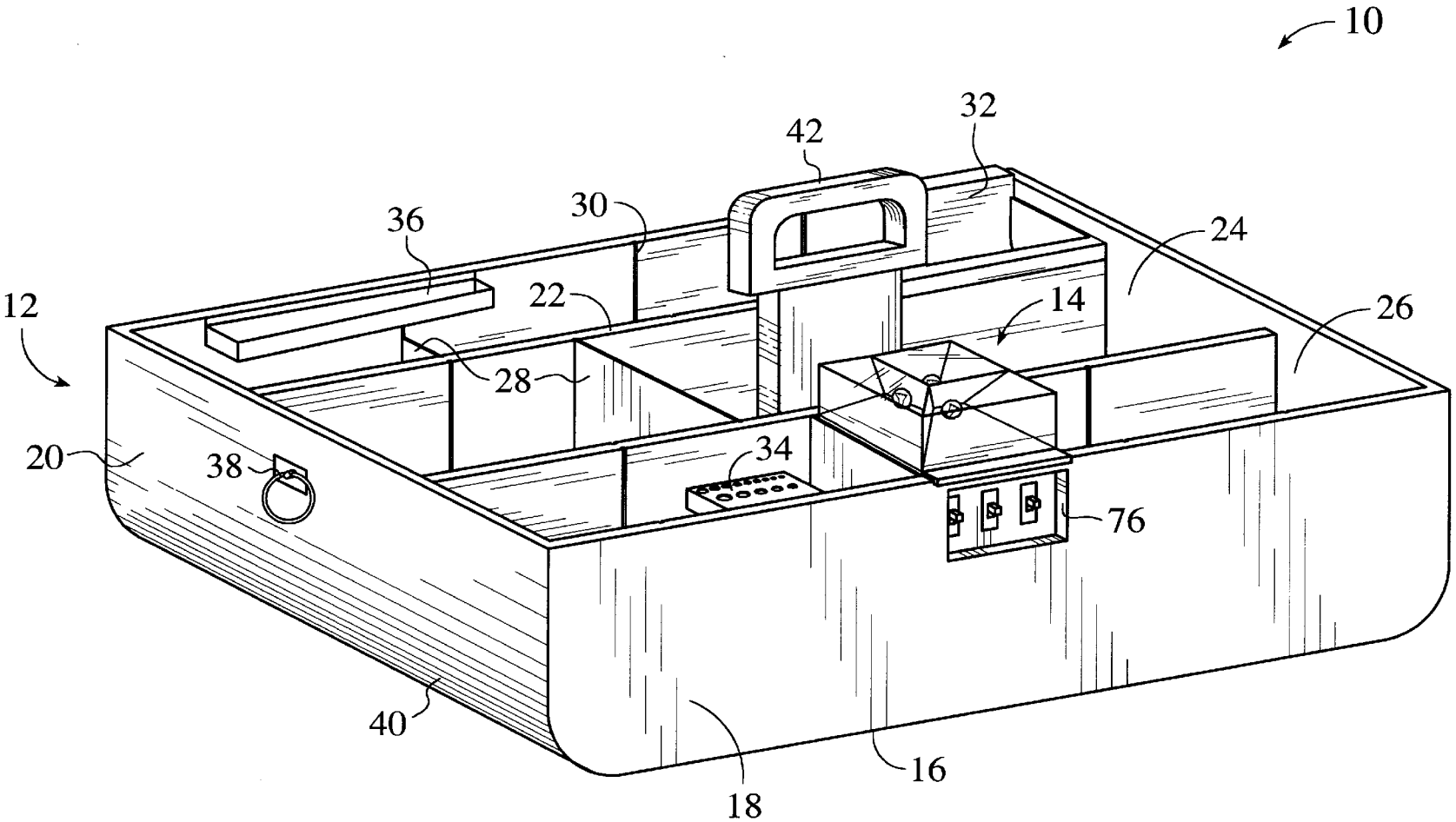
FIG. 1 is a perspective view of the preferred embodiment of the present invention.

The preferred embodiment of the present invention is a portable illuminated tool caddy with a simultaneously multi-directional lighting capability. The illuminated tool caddy of the preferred embodiment, although generally applicable to any work requiring the toting of tools and increased illumination, is directed towards work as would be performed in crawl spaces beneath houses. The illuminated tool caddy of the preferred embodiment is set forth in FIG. 1, where it is designated therein by the general reference character 10.

Referring initially to the perspective view shown in FIG. 1 of the drawings, the illuminated tool caddy 10 is seen to include the primary components of a compartmentalized tool carrier 12 and a uniquely designed lamp 14, the many capabilities and advantages of which will be described in further detail later herein. The tool carrier 12 has a generally rectangular shape including a bottom portion 16, and a pair of corresponding side walls 18. A pair of opposing end walls 20 are continuous, upwardly directed extensions of the bottom portion 16. The side walls 18 and end walls 20 are of a height as is convenient to provide for storage and access to various hand and power tools as might typically be contained and toted in a conventional tool box. A cover or lid is not shown in the drawing figures, although it is to be understood that such could be provided if desired.

Figure 2:
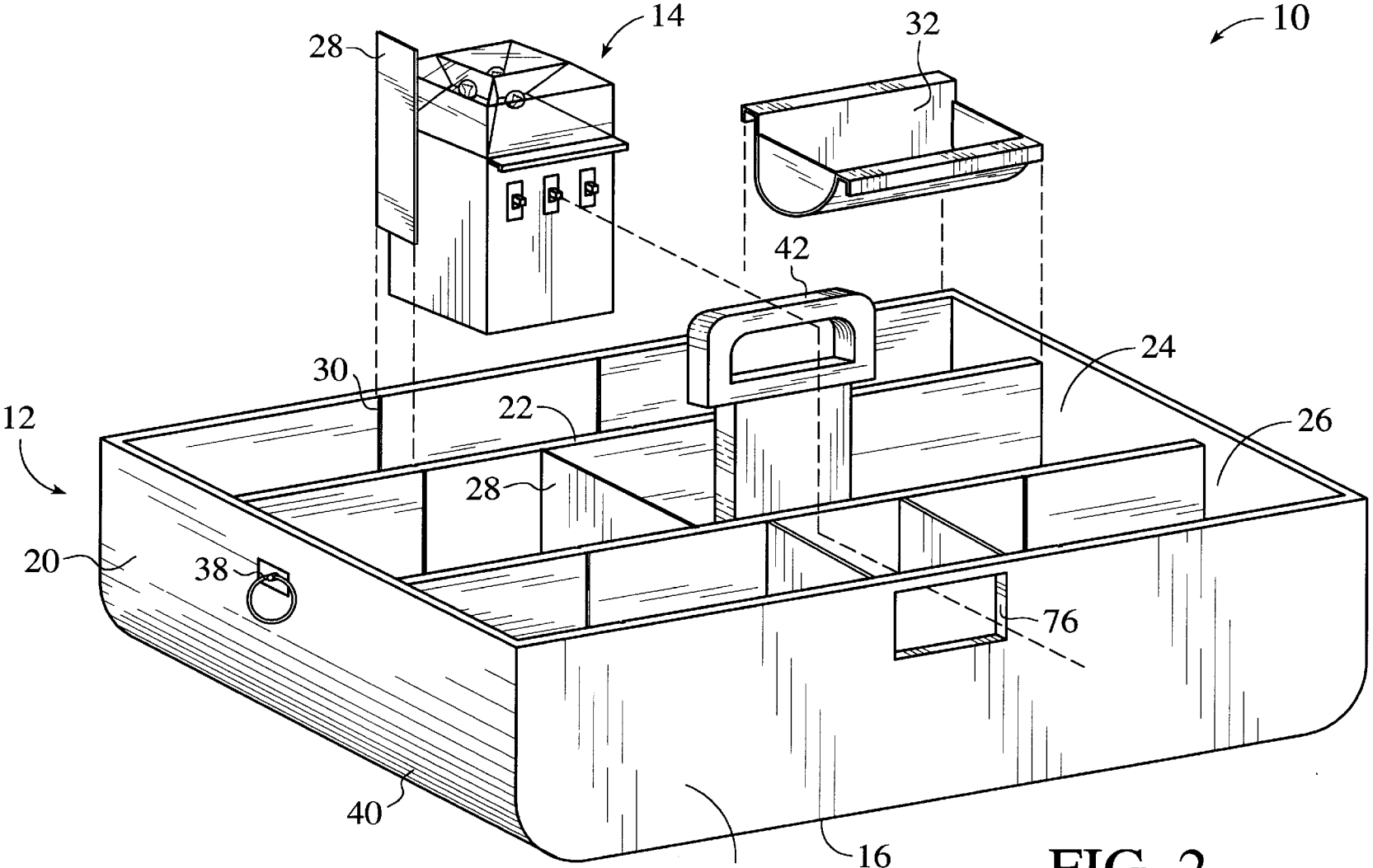
FIG. 2 is an exploded perspective view of the invention of FIG. 1.

Referring now to both the view of FIG. 1 and the identical but exploded view of FIG. 2, in the preferred embodiment of the present invention 10 there are shown to be two longitudinally extending permanent dividers 22 which partition the tool carrier 12 into three primary compartments 24. Smaller secondary compartments 26 are created at will within these primary compartments 24 by the use of removable dividers 28 which are oriented in transverse relation to the side walls 18 and permanent dividers 22. The removable dividers 28 are slidably introduced into opposing, vertically aligned grooves 30 present at any number of desired multiple locations in the interior surfaces of the side walls 18 and/or the permanent dividers 22. The removable dividers 28 can thus be used to provide for any number of such secondary compartments 26 of virtually any size and location within a primary compartment 24. Of course, any number of more permanently structured secondary compartments 26 could also be provided. A substantially undivided primary compartment 24 may be used for storage and transport of larger tools such as a power drill or large screw drivers and wrenches, while the smaller secondary compartments 26 may be used to contain smaller items such as a tape measure or stud finder.

Further useful tool and parts storage capability is provided by one or more slidable trays 32, by a drill bit holder 34, and by a socket holder 36. The slidable trays 32 have rounded bottoms so as to provide for convenient retrieval of screws, and nuts and bolts contained therein. The trays 32 are of a width such that the trays 32 may be supported and positioned atop the permanent dividers 22 and are slidably located thereon. The drill bit holder 34 and the socket holder 36 are permanent fixtures of a conventional design attached to the side walls 18 and allow drill bits and wrench sockets to be accessibly located.

It will be recognized that the precise nature of the organizational ability of the tool carrier 12 is not a critical aspect to the present invention, and that many variations exist with regard to such organizational character. For example, the tool carrier 12 might incorporate any number of such well-known, hingedly connected and collapsible tray systems as are commonly found in many tool and tackle boxes. The tool carrier 12 might incorporate, in addition, any variety of lift-out tray(s) as have handles and as are also commonly found in tool boxes and tool chests.

Continuing to refer to FIGS. 1 and 2, attached to each end wall 20 of the tool carrier 12 is a pulling ring 38. The pulling rings 38 have a special application in relation to the particular form of the tool carrier 12 of the preferred embodiment of the invention described herein. It is intended that the illuminated tool caddy 10 as shown be used for the transport of tools and for the illumination of work detail within restricted crawl spaces, particularly those beneath houses. The pulling rings 38 provide convenient attachment sites for a rope or cable which may then be used to drag the tool caddy 10 along the ground behind the worker where lifting and carrying of the tool caddy 10 is not easily permitted due to tight confines.

It is a further feature of the preferred embodiment, and one which is importantly conjunctive with the purpose of the pulling rings 38 described above, to provide for the lower portion of the end walls 20 of the tool carrier 12 to be curvedly fashioned where the end walls 20 connect in integral fashion with the bottom portion 16. These arcuate portions 40 greatly facilitate the slidability of the tool caddy 10 as it is either dragged or pushed along the ground in such situations as it is anticipated that the tool caddy 10 will be especially useful.

Extending upwardly from the bottom portion 16 and located within the middle of the three primary compartments 24 is a carrying handle 42. The carrying handle 42 allows the illuminated tool caddy 10 to be easily transported to and from various work locations as desired.

The tool carrier 12 of the present invention may be fashioned of any number of materials. Especially where the illuminated tool caddy 10 is intended and designed (as shown in the preferred embodiment herein) to be used in situations where dragging or pushing of the tool caddy 10 is facilitory to the work being performed, fabrication with sheet metal provides a sturdy tool carrier 10 capable of withstanding such repeated abrasive forces. The permanently affixed parts of the tool carrier 10, such as the carrying handle 42, may then be attached by means such as screws, bolts, or rivets. A variety of high-strength plastics may also be used for construction of the tool carrier 12 and are particularly appropriate where the illuminated tool caddy 10 serves in the role of a tackle box for fishing or where the tool carrier 12 will be in frequent contact with moisture.

The greatly enhanced lighting capability of the present invention is provided by the unique features of the lamp 14. Typically, as shown in FIG. 1, the lamp 14 is located and stored within one of the primary compartments 24 adjacent to a side wall 18. A variety of means may be used to provide for a removable positioning and holding of the lamp 14, including simple insertion within a secondary-type compartment 26. Although not shown, a removable metal cage may be provided for protection of the lamp 14 components from dropped tools or from being inadvertently struck against objects when the illuminated tool caddy 10 is carried.

Referring now to the perspective view of FIG. 3, the lamp 14 is seen to include a bulb housing 44 and an electrical housing 46, the electrical housing 46 being located directly below the bulb housing 44 and attached thereto. The bulb housing 44 may be made of any number of such clear plastic materials as permit light transmission, but unlike traditional flashlights, or similar light sources, the bulb housing 44 is partitioned into a multiplicity of individual lighting compartments 48. Each lighting compartment 48 produces and casts light in a predetermined manner, as will be explained shortly, giving the lamp 14 the ability to direct light simultaneously to virtually any location desired, including outwards to any side, upwards to any overhead location, and downwards to the ground and into the interior of the tool carrier 12.

Figure 3:
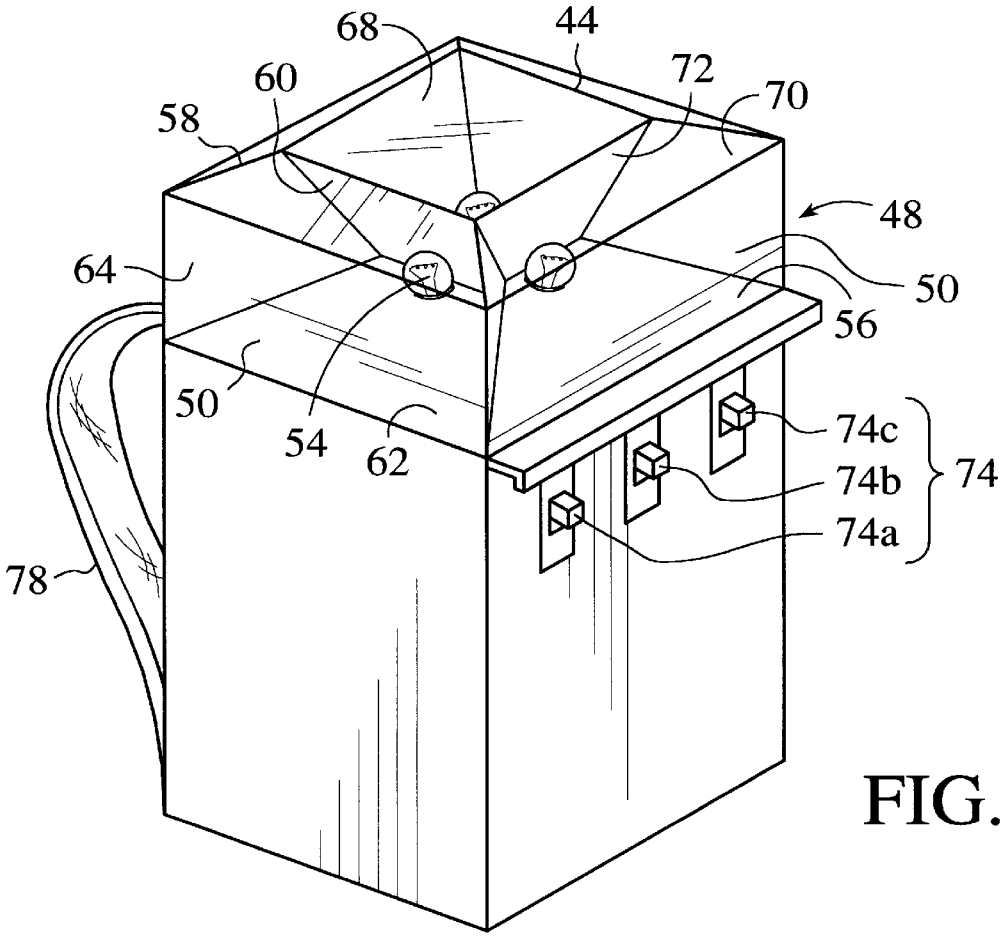
FIG. 3 is a perspective view of the lamp.
Figure 4:
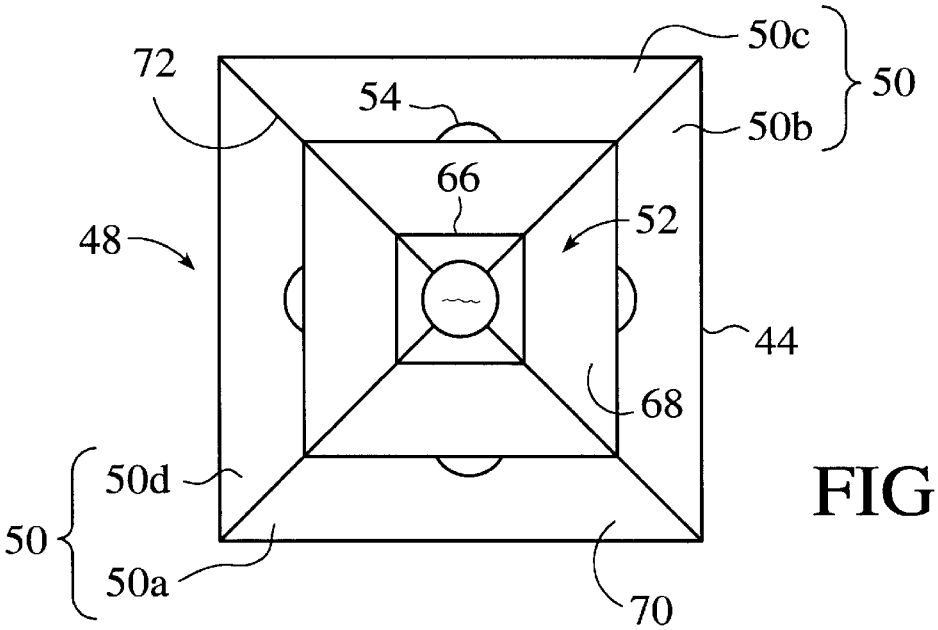
FIG. 4 is a top plan view of the lamp.

In the preferred embodiment as shown, and continuing to refer to FIG. 3 and also now to FIG. 4, five such lighting compartments 48 are present—four side lighting compartments 50 and one top lighting compartment 52. In the preferred embodiment, the bulb housing 44 is symmetrical, that is, each of the four side lighting compartments 50 are identical in structure, with the top lighting compartment 52 being centrally located between the four side lighting compartments 50. The structure of each lighting compartment 48, described below, imparts a faceted, gem-like character to both the exterior and interior surfaces of the bulb housing 44 and creates to a large degree the multi-directional lighting capability of the lamp 14. In fact, the inventors have denoted the lamp 14 as the "Diamond Light" due to its reflectively faceted nature.

Contained within each lighting compartment 48 is a single light bulb 54. Thus, five such light bulbs 54 are present within the bulb housing 44 of the preferred embodiment as shown. These light bulbs 54 may be of any of the varieties as are commonly found in flashlights or comparable lighting systems, and may include halogen-type and other high intensity bulbs.

Light produced by the light bulbs 54 is reflected and directed by means of reflector facets 56 that are present within each of the lighting compartments 48. The reflector facets 56 also cause a partitioning of the bulb housing 44 into the individual lighting compartments 48 and further cause each such lighting compartment 48 to have an internally faceted appearance. The external surface of the bulb housing 44, which as noted before is transparent, is similarly faceted with lens facets 58 which in some measure further optimize the lighting pattern that is cast by the light bulbs 54 and reflected by the reflector facets 56. These lens facets 58 also assist in maintaining the structural integrity of the specifically oriented reflector facets 56 (see below) and provide a certain aesthetic appearance to the bulb housing 44 as well.

In the preferred embodiment, within each side lighting compartment 50 there are four such reflector facets 56, including an upper reflector facet 60 and a lower reflector facet 62, each of which is trapezoidal in shape, and two side reflector facets 64, both of which have an identical, but irregular quadrilateral shape. Set within each lower reflector facet 62 is a single one of the light bulbs 54. It will be noted that the side reflector facets 64 are actually shared by adjacent side lighting compartments 50 and thus a total of only four such side reflector facets 64 are present within the bulb housing 44, with each being double-sided.

The top lighting compartment 52 has a horizontally planar central reflector facet 66 which is square in shape. Set within this central reflector facet 66, then, is a fifth light bulb 54. The top lighting compartment 52 shares in common with each of the side lighting compartments 50 the previously mentioned upper reflector facets 60. Thus, a total of five reflector facets 56 are found in the top lighting compartment 52. As will be intimated from the paragraph immediately following, the upper reflector facets 60, together with the central reflector facet 66 and a top lens facet 68, cause the top lighting compartment 52 to assume an inverted frusto-pyrimidical shape.

Within the side and top lighting compartments (50 and 52), the reflector facets 56 are oriented in various planes to achieve a multi-directional lighting capability beyond what is simply provided by a lamp 14 having five separate light bulbs 54 or even five separate lighting compartments 48. In the preferred embodiment, the upper reflector facets 60 of the side lighting compartments 50 are tilted at an angle of approximately thirty (30) degrees from vertical. Such an angle of relatively comparable magnitude provides that a usably good portion of the light produced from within the side lighting compartments 50 is directed downwards to the ground, or into the interior of the tool carrier 12, depending on the location of the particular side lighting compartment 50. This downwardly directed light provides that it is not necessary to reorient the light source (i.e., the lamp 14) when retrieval of a part or tool from within the tool carrier 12 is required, or if a part or tool is dropped to the ground and can't be immediately located. In fact, as will become evident, reorientation of any kind will rarely be necessary other than to perhaps move the illuminated tool caddy 10 closer to an intricate work detail for brighter illumination, since the lamp 14 provides focused light in all directions (the lamp 14 is also removable from the tool carrier 12—see below).

The upper reflector facets 60, of course, in conjunction with the central reflector facet 66, also act to concentrate and focus light produced in the top lighting compartment 52 in an upward direction in a manner substantially analogous to such a generally hyperbolically shaped reflector portion as is present in a typical hand held flashlight. The same is true with the remaining lower and side reflector facets (62 and 64), the side reflector facets 64 being vertically oriented, which together with the upper reflector facets 60 concentrate and focus light produced in the side compartments 50 in sideways fashion, and also downwards as noted previously. Light from the side lighting compartments 50 is also cast upward to locations less substantially lit by the top lighting compartment 52 by virtue of the lower reflector facets 62, which are tilted similarly to the upper reflector facets 60 but at an angle of approximately ten (10) degrees from horizontal. Upwardly directed light is also cast in direct fashion by the light bulbs 54 present in the side lighting compartments 50. In the preferred embodiment, the light bulbs 54 of the side lighting compartments 50 are tilted to the same degree as the lower reflector facets 62 (i.e., the light bulbs 54 are in geometrically normal relation to the planes presented by the lower reflector facets 62).

The reflector facets 56 may be made of any reflective material such as polished metals, including aluminum, or of plastics coated with reflective materials, or of reflective materials sandwiched between transmissive plastics, to mention but a few possibilities. The reflective materials may not be entirely reflective, but may have a translucent quality as well.

In the preferred embodiment, light passes directly from the light bulbs 54 or reflectively from the reflector facets 56 through a total of nine lens facets 58, there being four side lens facets 70 and four upper lens facets 72, one of each of which is a component of the side lighting compartments 50, and the one aforementioned top lens facet 68. The number and arrangement of reflector facets 56 and lens facets 58, it will be noted from the Figures, provide that each lighting compartment 48 has a hexahedronal shape, one of which, as noted previously, is more particularly of a frusto-pyrimidical shape.

Although it will be apparent to those skilled in the art, it must be noted that many variations with respect to the compartmentalization of the lamp 14 and/or reflectorization of individual ones of the lighting compartments 48 are contemplated by the inventors. For example, the desired multi-directional lighting capability may be obtained by more or fewer than five lighting compartments 48. Thus, there might be present three side lighting compartments 50 and one top lighting compartment 52, all symmetrically arrayed (although complete symmetry is not a requirement in any design) such that the top lighting compartment 52 has a frusto-pyrimidical pentahedral shape.

Further, it is not even an absolute requirement that a multiplicity of individual reflector facets 56 be incorporated. There might be present only five generally hyperbolically shaped reflectors at each of the locations corresponding to the five lighting compartments 48 as in the preferred embodiment. This would allow for a somewhat more intensely focused array of lighting, but with some loss of uniformity and breadth of illumination. In this vein, it will be noted that the bulb housing 44 and/or electrical housing 46 need not have the angular box-like appearance shown, but might have a cylindrical aspect. The bulb housing 44 might be facetless, as well.

While in the drawings the bulb housing 44 and electrical housing 46 are shown as having exterior side surfaces in flushable alignment, an alternative embodiment (not shown) provides that at least one side lighting compartment 50, in particular the side lighting compartment 50 closest to the relevant side wall 18, is laterally extended to overhang the tool carrier 12 and in which case the lower reflector facet 62 therein is made at least translucent and/or a lower portion of that side lighting compartment 50 is angled downward to provide an even better ground-lighting capability thereby. This embodiment does expose the lamp 14 to greater potential to damage from inadvertent jostling, etc., although an appropriately fashioned lamp cage would largely preclude this. In the vein of the foregoing, it is not necessary that the light bulbs 54 within the side lighting compartments 50 be substantially vertically oriented. Other orientations may be used to provide an increased downwardly directed illumination ability beyond that already provided.

The lamp 14 of the preferred embodiment is provided with additional features that further enhance its utility. These are described in this and subsequent paragraphs. As shown in FIG. 3, the lamp 14 is provided with three electrical switches 74 which are located on the electrical housing 46. Each electrical switch 74 controls certain of the light bulbs 54 within the five lighting compartments 48. A first switch **74*a* turns the light bulb 54 of the top lighting compartment 52 on and off. A second switch 74*b* turns the light bulbs 54 of two adjacent ones of the side lighting compartments (50*a* and 50*b*) on and off. And a third switch 74*c* turns the light bulbs 54 of the remaining adjacent side lighting compartments (50*c* and 50*d*) on and off. This arrangement provides that any lighting capability that is not necessary for a certain direction or directions may be suspended in order to prolong bulb life and reduce electrical consumption. It will be noted that the presence of multiple bulbs 54 within the lamp 14** essentially precludes situations from occurring in which the worker finds him- or herself without light due to a bulb failure.

Referring to FIGS. 1 and 2, in the preferred embodiment as shown, a rectangularly shaped aperture 76 within one of the side walls 18 of the tool carrier 12 allows convenient access to the electrical switches 74, although the electrical switches may located virtually anywhere and such an aperture 76 is not an essential requirement.

As has been indicated, the lamp 14 is removable from within the tool carrier 12 to be hand held where that is desirable. To assist in carrying ease, a lamp strap or lamp handle 78 is provided (FIG. 3). The lamp 14 may thus be used as if a typical flashlight when needed. The bottom of the lamp 14 may also be provided with a hanging ring (not shown) so that the lamp 14 may be hung as if a droplight. The preferred lamp 14 is approximately 15.2 cm (6.0 in) in overall height, the bulb housing 44 being approximately 3.8 cm (1.5 in) in height, and is approximately 7.6 cm (3.0 in) square. The foregoing dimensions are not to be construed as limiting in any way, however, since it is readily apparent that the invention of the illuminated tool caddy 10 may present itself in many shapes and sizes.

In the preferred embodiment, electrical power for the light bulbs 54 is provided by a rechargeable battery 80 (not shown) located within the electrical housing 46. It is also anticipated that certain embodiments of the present invention may incorporate a conventional electrical cord to provide A.C. current to suitably rated light bulbs. In the latter case, an electrical socket(s) may also be located on the electrical housing to provide a convenient source of electricity for power tools, and thereby avoid the need for a separate extension cord.

In addition to the above mentioned examples, it is to be understood that various other modifications and alterations with regard to the types of materials used, their method of joining and attachment, and the shapes, dimensions and orientations of the components as described may be made without departing from the invention. Accordingly, the above disclosure is not to be considered as limiting and the appended claims are to interpreted as encompassing the entire spirit and scope of the invention.

INDUSTRIAL APPLICABILITY

The illuminated tool caddy 10 of the present invention is designed to be used for any application requiring convenient, hands-free illumination of a work, hobby or recreationally-related area, space or detail. Typical applications of the particular preferred embodiment as shown include the aforementioned application of working within crawl spaces or other restricted confines, such as those located beneath houses or in attics, or within sink cabinets, or beneath automobiles. Other applications of substantially similar (or identical) preferred embodiments of the present invention include a tackle box embodiment for twilight fishing, which was also mentioned previously, camping and evening picnics, for which purposes items other than tools, such as food, can be carried within the "tool" carrier 12, and any sort of maintenance work generally (plumbing and electrical repair, etc.), to mention but a few of many conceivable possibilities.

Use of the illuminated tool caddy 10 is simple. The tool caddy 10 is carried by the carrying handle 42, or dragged by the pulling ring 38, to the appropriate location. The electrical switches 74 are then used to turn on the light bulbs 54 within all the lighting compartments 48 or selected light compartments 48 are utilized as desired. One's hands are then completely freed to perform the task at hand. As the worker moves from work detail to work detail, or retrieves tools or parts from within the tool carrier 12, no annoying repositioning or reorientation of the lamp 14 is generally necessary, except perhaps where close-up detail work is being performed. If necessary, the lamp 14 may be removed from the tool carrier 12 for hand-held carrying, when it is not desired that the tool carrier 12 be taken along, or when the application requires illumination within a very small space.

The illuminated tool caddy 10 greatly increases the ease and efficiency with which tasks that require supplemental lighting may be carried out. For these reasons and numerous others as set forth previously herein, it is expected that the industrial applicability and commercial utility of the present invention will be extensive and long lasting.

What is claimed is:

1. A portable lighting system, comprising:

a carrier portion, said carrier portion having side walls, end walls, and a carrier portion interior, said carrier portion including handle means for toting said carrier portion;

a light source operatively associated with said carrier portion, said light source including a bulb housing, the bulb housing containing a plurality of light bulbs and a multiplicity of reflector facets, the light cast by each light bulb being reflected and directed by the reflector facets, at least one of the reflector facets positioned so as to reflect and direct light in a generally downward direction so as to cast light upon at least one of the carrier portion interior and a ground area; and said operative association includes said light source being located within the carrier portion interior and wherein the bulb housing extends above at least one of the side walls and end walls.

2. The portable lighting system of claim 1 wherein said light source is removable from said carrier portion, said light source further having means for hand-held operation.

3. The portable lighting system of claim 1 wherein the end walls include an arcuate lower portion for enhanced slidability along the ground.

4. The portable lighting system of claim 1 wherein the reflector facets are positioned so as to form individual lighting compartments within the bulb housing, each lighting compartment including one of the light bulbs.

5. The portable lighting system of claim 4 wherein there are at least three of the lighting compartments, two of which lighting compartments include reflector facets that reflect and direct light emitted from the corresponding light bulbs in a generally sideways direction, one of which lighting compartments include reflector facets that reflect and direct light emitted from the corresponding light bulb in a generally upwards direction.

6. The portable lighting system of claim 4 wherein the lighting compartments have a hexahedronal shape.

7. The portable lighting system of claim 1 wherein the bulb housing has a multi-faceted external appearance for optimizing the transmission and distribution of the light cast by the light bulbs.

8. The portable lighting system of claim 1 further including switch means for selectively turning on and off individual ones and combinations of the light bulbs.

9. A multi-directional light, comprising:

a bulb housing, said bulb housing having a top surface;

a plurality of light bulbs;

a multiplicity of reflector facets, said reflector facets positioned so as to compartmentalize said bulb housing into a plurality of individual lighting compartments, each lighting compartment including at least one said light bulb, said reflector facets further positioned so as to reflect and direct light produced within the lighting compartments in multiple directions, the multiple directions including at least in the direction of the top surface and directions generally angularly obtuse to the direction of the top surface; and there are at least three of the lighting compartments, one of which lighting compartments includes such said reflector facets as to reflect and direct light emitted from the corresponding light bulb in the top surface direction, at least two of which lighting compartments include such said reflector facets as to reflect and direct light emitted from the corresponding light bulbs in a direction generally perpendicular to the top surface direction.

10. The multi-directional light of claim 9 further including switch means for selectively turning on and off individual ones and combinations of the light bulbs.

11. The multi-directional light of claim 9 wherein the bulb housing has a multi-faceted external appearance for optimizing the transmission and distribution of the light emitted by the light bulbs.

12. The multi-directional light of claim 9 wherein the lighting compartments have a hexahedronal shape.

13. A tool caddy, comprising:

a base member joined to a pair of opposed substantially vertically oriented side walls, said base member being upwardly curved to also form a pair of opposed substantially vertically oriented end walls, said base member being adapted for sliding along a surface thereby;

a plurality of interior plate members formed so as to extend between opposing ones of the end walls and side walls, said interior plate members creating separate compartments thereby;

attachment means formed on said base member for attaching tether means thereto for pulling to facilitate the sliding;

handle means attached to said base member for toting;

at least one of the separate compartments is adapted to receive a light source; and said light source includes a bulb housing having at least two light bulbs, and directing means for directing the light emitted by the light bulbs in at least two directions, one of which directions includes into at least one of the separate compartments not occupied by the light source.

14. The tool caddy of claim 13 wherein the light source includes a bulb housing having a plurality of individual lighting compartments, and a multi-faceted external appearance for optimizing the transmission and distribution of the light cast by each of the lighting compartments.

15. The tool caddy of claim 13 wherein the light source is removable for hand-held operation.

16. The tool caddy of claim 13 wherein said attachment means includes a pulling ring.

* * * * *